US006642904B2

(12) United States Patent
Yokoshima et al.

(10) Patent No.: US 6,642,904 B2
(45) Date of Patent: Nov. 4, 2003

(54) ANTENNA

(75) Inventors: Takao Yokoshima, Tokyo (JP); Toshiyuki Chiba, Tokyo (JP); Shiro Sugimura, Kanazawa (JP); Hideki Kobayashi, Kanazawa (JP)

(73) Assignees: Mitsubishi Materials Corporation, Tokyo (JP); FEC Co., Ltd., Kanazawa (JP)

( * ) Notice: Subject to any disclaimer, the term of this patent is extended or adjusted under 35 U.S.C. 154(b) by 0 days.

(21) Appl. No.: 09/984,146

(22) Filed: Oct. 29, 2001

(65) Prior Publication Data

US 2002/0075191 A1 Jun. 20, 2002

(30) Foreign Application Priority Data

Oct. 31, 2000 (JP) ..... 2000-333711
Sep. 19, 2001 (JP) ..... 2001-285554

(51) Int. Cl.[7] ..... H01Q 1/38
(52) U.S. Cl. ..... 343/829; 343/860
(58) Field of Search ..... 343/850, 860, 343/702, 829, 830

(56) References Cited

U.S. PATENT DOCUMENTS 4,644,366 A 2/1987 Scholz ..... 343/702

FOREIGN PATENT DOCUMENTS

| | | |
|---|---|---|
| DE | 26 29 685 | 1/1978 |
| DE | 198 42 705 | 4/2000 |
| EP | 0 367 609 | 5/1990 |
| EP | 0 706 231 | 4/1996 |
| JP | 05-015515 | 2/1993 |
| JP | 05-031323 | 4/1993 |
| JP | 07-297627 | 11/1995 |
| JP | 07-321550 | 12/1995 |
| JP | 08-051313 | 2/1996 |
| JP | 08-288739 | 11/1996 |
| JP | 09-098009 | 4/1997 |
| JP | 09-153734 | 6/1997 |
| JP | 09-219610 | 8/1997 |
| JP | 10-013138 | 1/1998 |
| JP | 10-013139 | 1/1998 |
| JP | 10-032413 | 2/1998 |
| JP | 10-032421 | 2/1998 |
| JP | 10-084218 | 3/1998 |
| JP | 10-107537 | 4/1998 |
| JP | 10-209733 | 8/1998 |
| JP | 10-256825 | 9/1998 |
| JP | 11-004113 | 1/1999 |
| JP | 11-055022 | 2/1999 |
| JP | 2001-196831 | 7/2001 |

*Primary Examiner*—Michael C. Wimer
(74) *Attorney, Agent, or Firm*—Oblon, Spivak, McClelland, Maier & Neustadt, P.C.

(57) ABSTRACT

An antenna is provided to improve the gain and to eliminate various negative effects caused by a surrounding environment in which the antenna is mounted, such as the effects caused by neighboring metal plates and the like, while providing an antenna structure to facilitate its assembly into various communication devices. The antenna emitting radio waves at a center frequency has an antenna main body and a grounding line section connected to the ground-side of the coaxial cable for supplying power to the antenna main body. The grounding line section starts from a reference point and extends in a loop so as to surround the antenna main body, and portions of the conductor line are severed so as to provide a first end terminal and a second end terminal so that the length of the conductor line from the reference point to the first end terminal corresponds to one quarter of a wavelength of the center frequency or its integral multiple.

10 Claims, 7 Drawing Sheets

ANTENNA

BACKGROUND OF THE INVENTION

1. Field of the Invention

The present invention relates to an antenna, particularly a compact antenna suitable for inclusion in various devices having capabilities for processing radio signals, including various communication devices that can transmit and receive radio signals.

2. Description of the Related Art

In recent years, there have been increasing uses for antennas that can be used in frequency bands in a range of several hundreds of MHz to several tens of GHz due to increasing demand for various devices having capabilities for transmitting and receiving radio signals, including various communication devices for processing radio signals. Obvious uses for such antennas include mobile communications, next generation traffic management systems, non-contacting type cards for automatic toll collection systems, but in addition, because of the trend toward the use of wireless data handling systems that enable to handle data, without using cumbersome lengthy cables, such as cordless operation of household appliances through the Internet, Intranet radio LAN, Bluetooth and the like, it is anticipated that the use of such antennas will also be widespread in similar fields. Furthermore, such antennas are used in various systems for wireless data handling from various terminals, and the demand is also increasing for applications in telemetering for monitoring information on water pipes, natural gas pipelines and other safety management systems and POS (point-of-sale) terminals in financial systems. Other applications are beginning to emerge over a wide field of commerce including household appliances such as TV that can be made portable by satellite broadcasting as well as vending machines.

To date, such antennas described above used in various devices having capabilities for receiving and transmitting radio signals are mainly monopole antennas attached to the casing of a device. Also known are helical antennas that protrude slightly to the exterior of the casing.

However, in the case of monopole antennas, it is necessary to extend the structure for each use of the device to make the operation cumbersome, and, there is a further problem that the extended portion is susceptible to breaking. Also, in the case of the helical antennas, because a hollow coil that serves as the antenna main body is embedded in a covering material such as polymer resin for protection, the size of device tends to increase if it is mounted on the outside the casing and it is difficult to avoid the problem that the aesthetics suffers. Nevertheless, reducing the size of the antenna leads only to lowering of signal gain, which inevitably leads to increasing the circuit size for processing radio signals to result in significantly higher power consumption and a need for increasing the size of the battery, and ultimately leading back to the problem that the overall size of the device cannot be reduced.

On the other hand, when attempts are made to realize a high gain compact antenna comprised by a resonant circuit having an inductance section and a capacitance section to transmit and receive radio waves, antenna gain is affected by the environment in which the antenna in mounted such as effects from the casing of the device, and especially, if a grounded metal plate is nearby, it does not function as antenna.

SUMMARY OF THE INVENTION

The present invention is provided to resolve the problems described above in an antenna that enables to produce high antenna gain when incorporated into a device and to eliminate adverse effects of environment in which the antenna is mounted such as effects from grounded metal plates.

A first aspect of the antenna of the present invention relates to an antenna comprising an antenna main body that resonates at a center frequency and a grounding line section, connected to a ground-side of a feed line, for supplying power to the antenna main body, and emitting radio waves at the center frequency, wherein the grounding line section has a conductor portion that extends from a start terminal at which the grounding line section is connected to the feed line to a first end terminal.

By having such a structure, the antenna main body and the grounding line section floated from the surrounding ground works cooperatively to transmit or receive radio waves so that the antenna gain is improved. It is preferable that the grounding line section is formed at some distance from the antenna main body so as to prevent shorting caused by the current flowing through the capacitance existing between the antenna main body and the grounding line section. This distance of separation depends on the center frequency used for radio waves transmission and reception, but at least 10 mm is required around 450 MHz to prevent lowering the gain.

A second aspect of the antenna relates to the antenna described in aspect one, wherein a length of the conductor portion extending from the start terminal of the grounding line section to the first end terminal of the grounding line section is one quarter or an integral multiple of one quarter of the wavelength of a radio wave at the center frequency.

By having such a structure, the grounding line section is made to resonate in fixed phase so that the node of the waves always coincides with the start terminal of the shorted grounding line section, the antenna gain is improved. The length of the conductor portion between the start terminal and the first end terminal should be an integral multiple of one quarter of a wavelength of the center frequency used for transmitting and receiving radio waves through the antenna, and it is most preferable that this length is one quarter or one half of the wavelength. In this case, the longer the length of the grounding line section the higher the gain. Of course, to make the antenna smaller, it is preferable that the length of the grounding line section is one quarter of the wavelength. Although gain is not sufficiently high, similar results are obtained when the length between the start terminal of the grounding line section and the first end terminal is one eighth of the wavelength of the radio wave at the center frequency.

Also, the present invention relates to the antenna in the second aspect, wherein an impedance matching section for matching impedance values is provided between the feed end of the antenna main body and the feed line; and the impedance matching section has a matching inductance section; such that the ends of the matching inductance section are, respectively, connected electrically to the feed end of the antenna main body and to a midpoint between the start terminal of the grounding line section and the first end terminal, or it is connected electrically to the feed end of the antenna main body and to a connection site located between the start terminal and the first end terminal of the grounding line section, in such a way that a length of a part of the grounding line section extending from the start terminal to the connection site is one eighth of a wavelength of a radio wave at the center frequency.

By having such a structure, impedance matching between the circuits in the radio wave transmission and reception system and the antenna is carried out so as not to lower the antenna gain.

A third aspect of the invention relates to the antenna in the second aspect, wherein the grounding line section further has a conductor portion formed by extending from the start terminal to a second end terminal that is distanced from the first end terminal.

In this case, as a fourth aspect of the invention, it is preferable that a frequency adjusting capacitance section is provided between an exit end of the antenna main body opposite to the feed point of the antenna main body and the second end terminal of the grounding line section for adjusting the center frequency.

Further, a fifth aspect of the invention relates to the antenna in the fourth aspect, wherein a length of the conductor portion extending from the start terminal of the grounding line section to the second end terminal of the grounding line section is one eighth of the wavelength of a radio wave at the center frequency.

By having such a structure, higher gains can be achieved compared with the case of an antenna having only the conductor portion extending from the start terminal of the grounding line section to the first end terminal. Further, it enables to adjust the center frequency used for transmission and reception of radio waves so as not to lower the antenna gain.

In this case, it is preferable that the grounding line section is provided so that the conductor portion formed by extending from the start terminal to the first end terminal and the conductor portion formed by extending from the start terminal to the second end terminal surround the antenna main body, so that the first end terminal and the second end terminal are opposite to each other in such a way that these conductor portions form a loop shape having an opening at the first end terminal and at the second end terminal.

By having such a structure, a portion of the grounding line section is severed to provide the end terminal, and because it does not form a ring, the electromagnetic field from the antenna is released to the surrounding without causing eddy current to form in the grounding line section.

A sixth aspect of the invention relates to the antenna in the fifth aspect, wherein it is preferable that the grounding line section is comprised by a conductor pattern fabricated on a substrate.

By having such a structure, the grounding line section is formed on an insulated substrate to enable it to be handled as one unit when assembling the antenna into various devices having capabilities for transmitting and receiving radio waves.

Further, a seventh aspect of the invention relates to the antenna in the sixth aspect, wherein the antenna main body is constructed so that a plurality of resonance sections, each having an inductance section and a capacitance section connected electrically in parallel, are connected electrically in series so as to resonate at the center frequency.

By having such a structure, because the antenna main body is made compact by integrated circuits, assembling of the antenna into various devices having capabilities for transmitting and receiving radio waves is facilitated.

Additionally, the inductance section and the capacitance section are comprised by a plurality of conductor sections formed on a plurality of laminated substrate plates, and it is preferable that the plurality of substrate plates be formed as one unit.

By having such a structure, because the antenna main body is constructed as one unit comprised by laminating a plurality of substrate plates, assembling of the antenna into various devices having capabilities for transmitting and receiving radio waves is facilitated.

Further, it is preferable that the antenna main body is mounted on a substrate body for integrating the antenna main body with the substrate body.

By having such a structure, the antenna main body and a substrate formed with the grounding line section can be handled as one unit, thereby facilitating assembly of the antenna into various devices having capabilities for transmitting and receiving radio waves.

Beneficial effects of the antenna of the present invention are summarized in the following.

According to the present invention, the antenna is provided with an antenna main body and a grounding line section, connected to the ground-side of the feed line, for supplying power to the antenna main body in such a way that the grounding line section has a conductor portion extending from the start terminal to the end terminal, and therefore, radio waves are transmitted or received by the cooperative action of the antenna main body and the grounding line section floating from the surrounding ground, and therefore, the antenna gain is improved.

Also, according to the present invention, because the length from the start terminal to the end terminal of the grounding line section is made equal to one quarter of the wavelength of the center frequency of radio waves or its integral multiple value, so that the grounding line section is resonated and the phases of the resonating waves are fixed in such a way that the node of the waves always coincides with the start terminal of the grounding line section to be grounded, thereby increasing the gain.

Also, according to the present invention, an impedance matching section is provided between the feed end of the antenna main body and the feed line for matching impedance values, and the impedance matching section has a matching inductance section, such that the ends of the matching inductance section are connected electrically to the feed end of the antenna main body and to a midpoint between the start terminal of the grounding line section and the first end terminal, respectively, so that impedance matching between the radio wave processing system circuitry and the antenna can be carried out so as not to lower the antenna gain.

Also, according to the present invention, an impedance matching section is provided between the feed end of the antenna main body and the feed line for matching impedance values, and the impedance matching section has an matching inductance section, and the ends of the matching inductance section are, respectively, connected electrically to the feed end of the antenna main body and to a connection site that is separated from a start terminal of the grounding line section at a distance equal to one eighth of the wavelength of a radio wave at the center frequency so that impedance matching between the radio wave processing system circuitry and the antenna can be carried out so as not to lower the antenna gain.

Also, according to the present invention, the grounding line section further has a conductor portion that extends from the start terminal to the second end terminal so that the effects due to surrounding environment can be reduced further, and the antenna can be assembled into devices without lowering the antenna gain.

Also, according to the present invention, because a frequency adjusting capacitance section for adjusting the center frequency is provided between an exit end, which is opposite to the feed point of the antenna main body, and the second end terminal of the grounding line section, adjustment of the center frequency can be carried out so as not to lower the antenna gain.

Also, according to the present invention, because the length of the conductor portion extending from the start terminal to the end terminal of the grounding line section is made equal to one eighth of the wavelength of a radio wave at the center frequency, relatively high gain can be obtained compared with an antenna having only a conductor portion that extends from the start terminal connected to the feed line to the first end terminal.

Also, according to the present invention, because the grounding line section is provided in such a way that the conductor portion formed by extending from the start terminal to the first end terminal and the conductor portion formed by extending from the start terminal to the second end terminal surround the antenna main body, and that the first end terminal and the second end terminal are opposite to each other so that these conductor portions are formed in a loop shape having an opening at the first end terminal and at the second end terminal, the electromagnetic energy from the antenna can be released to the surrounding without causing eddy current inside the grounding line section.

Also, according to the present invention, because the grounding line section is comprised by conductor patterns formed on respective substrates, the antenna can be assembled easily into various devices having radio wave communication capabilities.

Also, according to the present invention, because the antenna main body is comprised by an inductance section and a capacitance section connected electrically in parallel, and a plurality of these resonance sections are connected electrically in series so as to resonate at the center frequency, the antenna can be made compact so that the antenna can be assembled easily into various devices having radio wave communication capabilities.

Also, according to the present invention, because the inductance section and the capacitance section are comprised by a plurality of conductor sections formed on a plurality of laminated substrate plates, and the plurality of substrate plates are formed as one unit, so that the antenna can be assembled easily into various devices having radio wave communication capabilities.

Also, according to the present invention, because the antenna main body is mounted on a substrate body so as to produce one antenna unit by integrating the antenna main body with the substrate body, the antenna can be assembled easily into various devices having radio wave communication capabilities.

DESCRIPTION OF THE PREFERRED EMBODIMENTS

Preferred embodiments will be explained with reference to the drawings.

FIGS. 1 to 6 show an embodiment of the antenna of the present invention. In these diagrams, antenna A is comprised by an antenna main body 1 and a grounding line section 2, and is constructed to emit radio waves at a center frequency of 450 MHz.

Figure 2:
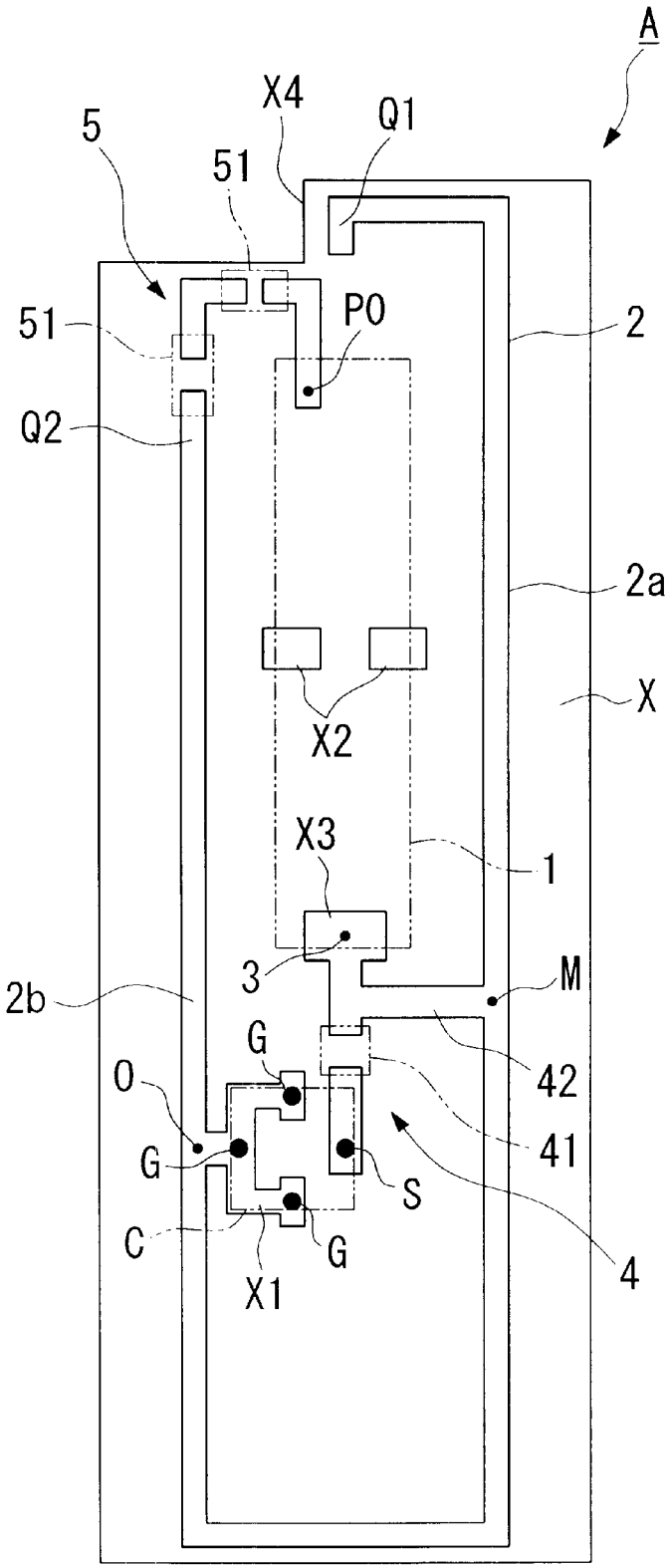
FIG. 2 is a diagram to show a grounding line section of the present antenna formed on a substrate.

As shown in FIG. 2, the outer conductor of the coaxial cable C (feed line) on the ground-side for powering the antenna is connected electrically at a junction point G, while the inner conductor is connected electrically to a junction point S.

Also, between the junction point S and the feed point 3 formed at the feed end of the antenna main body 1, impedance matching section 4 is provided to match the circuit-side impedance value of the wave transmission/reception system by adjusting the input impedance value of antenna A.

Further, the junction point P0 provided on the exit end opposite to the feed end of the antenna main body 1 is shorted to the grounding line section 2 by mounting the frequency adjusting capacitance section 5 so that the center frequency of the radio waves emitted from the antenna A can be adjusted.

Figure 1:
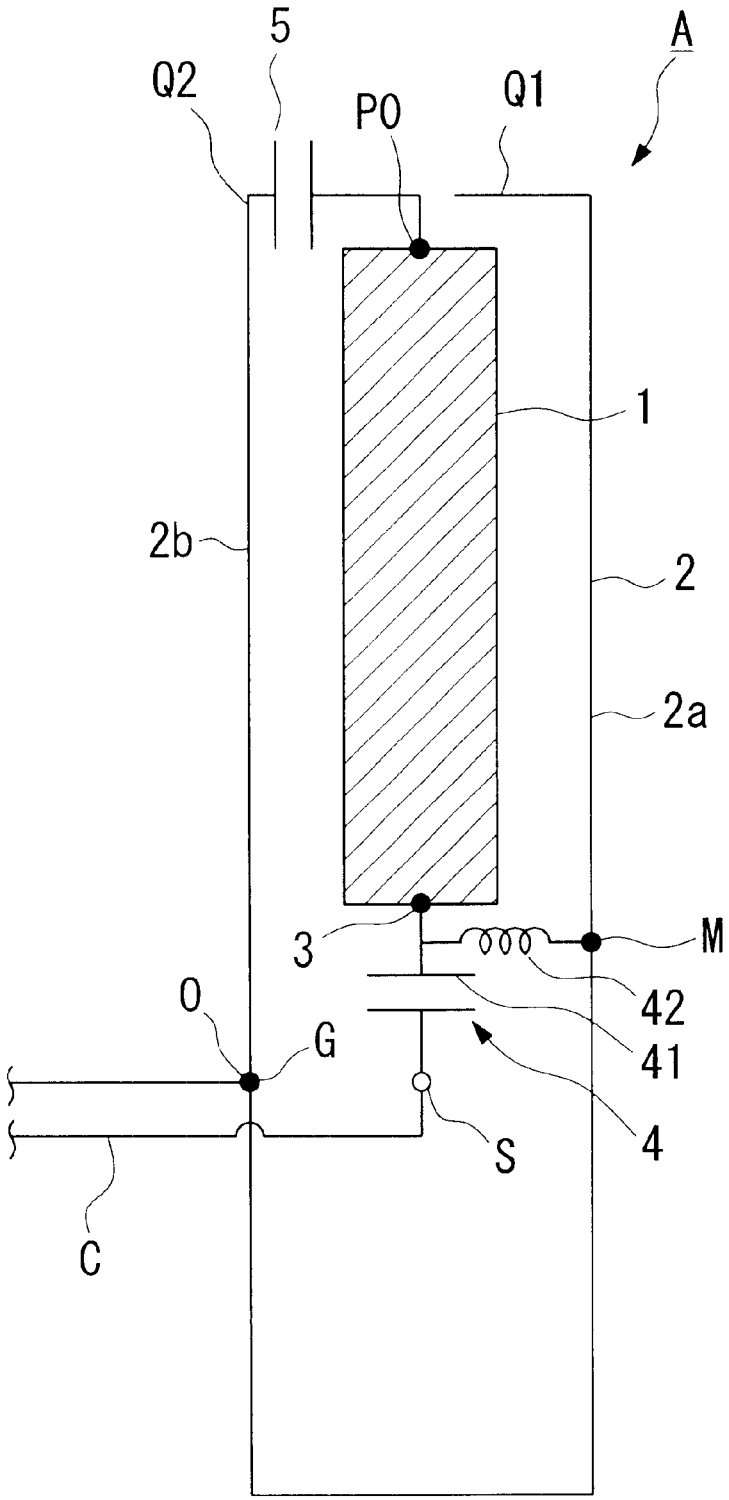
FIG. 1 is a schematic diagram of an embodiment of the antenna of the present invention.
Figure 3:
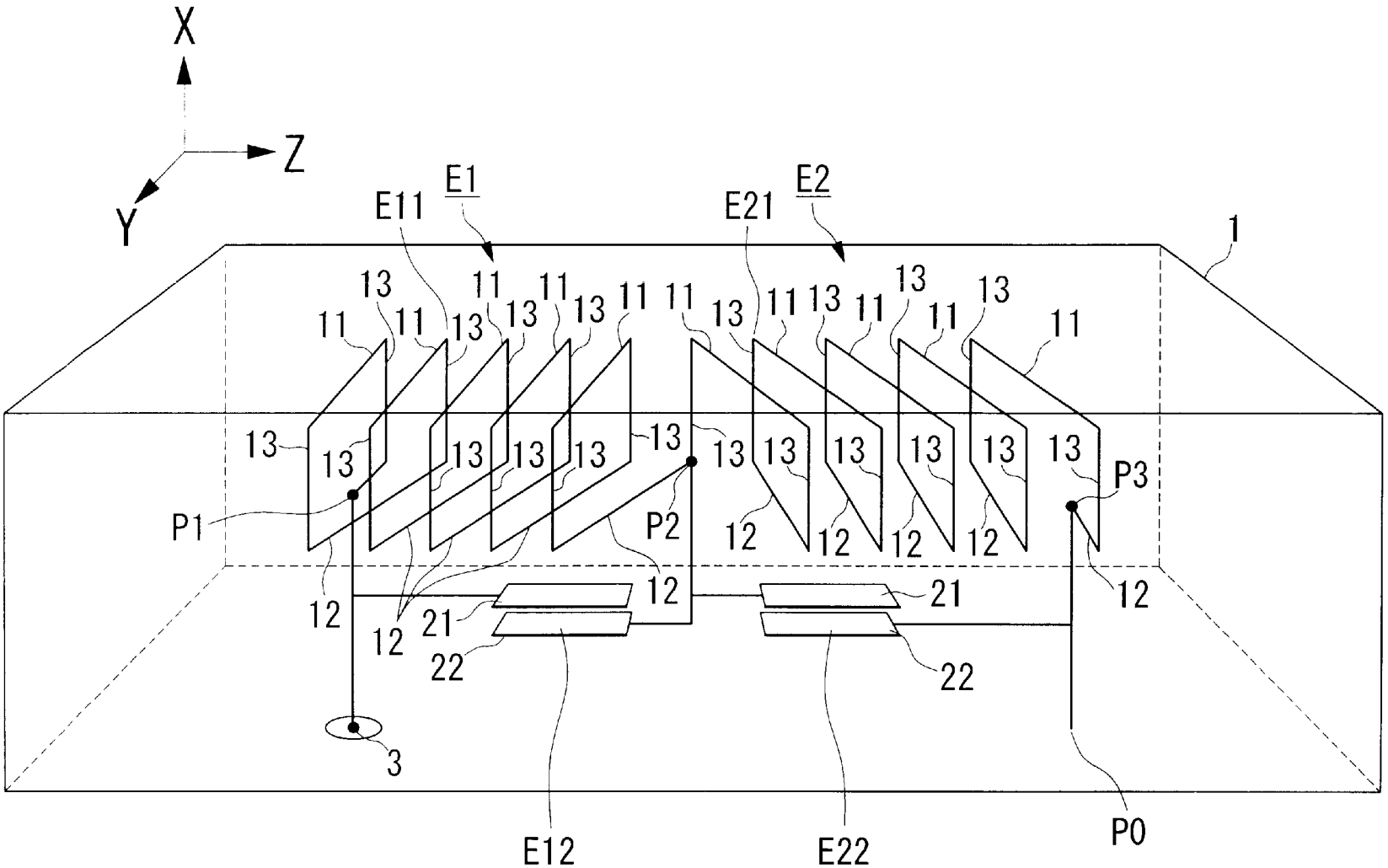
FIG. 3 is a perspective view of an antenna main body of the antenna of the present invention.
Figure 6:
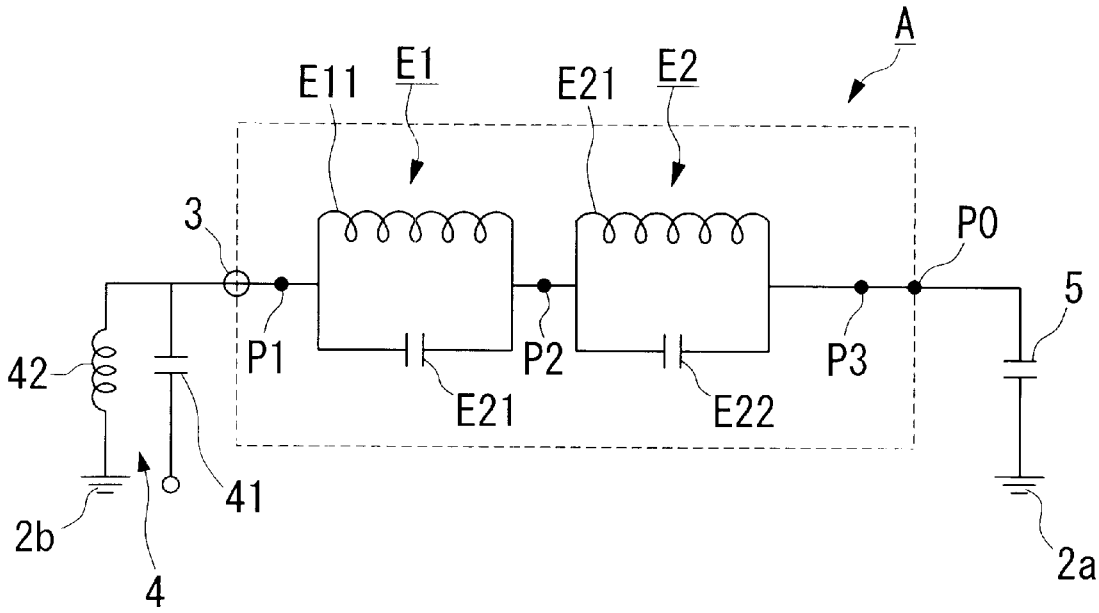
FIG. 6 is an equivalent circuit diagram of the antenna of the present invention.

As shown in FIGS. 1 to 3, the antenna main body 1 has two resonance sections E1, E2, which are connected electrically in series. Each of the antenna elements E1, E2 is comprised by an inductance section E11, E21 and a capacitance section E12, E22, which are connected in parallel, respectively. One end P1 of the resonance section E1 is connected to the feed point 3 for supplying power to the resonance sections E1, E2, while, the exit end P3 of the resonance section E2 is connected to the junction point P0. FIG. 6 shows an equivalent circuit of these connections.

Each of the inductance sections E11, E12 is comprised by a conductor body resembling a square shaped spiral centered about a coil axis, and this conductor body has parallel conductor patterns (conductor sections) 11, formed on the front surface of the substrate plate 10 (plate shaped substrate), and parallel conductor patterns 12 (conductor sections) formed on the back surface of the substrate plate 10, and coil conductor sections 13 comprised by an electrical conductor such as metal or conductive polymer filled in the through-holes punched through the substrate plate 10 in the thickness direction. The conductor bodies are constructed so as to spiral in the same direction (clockwise direction in this embodiment) for a number of turns (five turns in this embodiment) about the respective coil axes. The inductance sections E11, E21 are connected so that the coil axes are substantially collinear through the junction point P2. Here, the inductance value of the inductance sections E11, E21 thus formed in this embodiment is 69 nH at 1 MHz.

Figure 4:
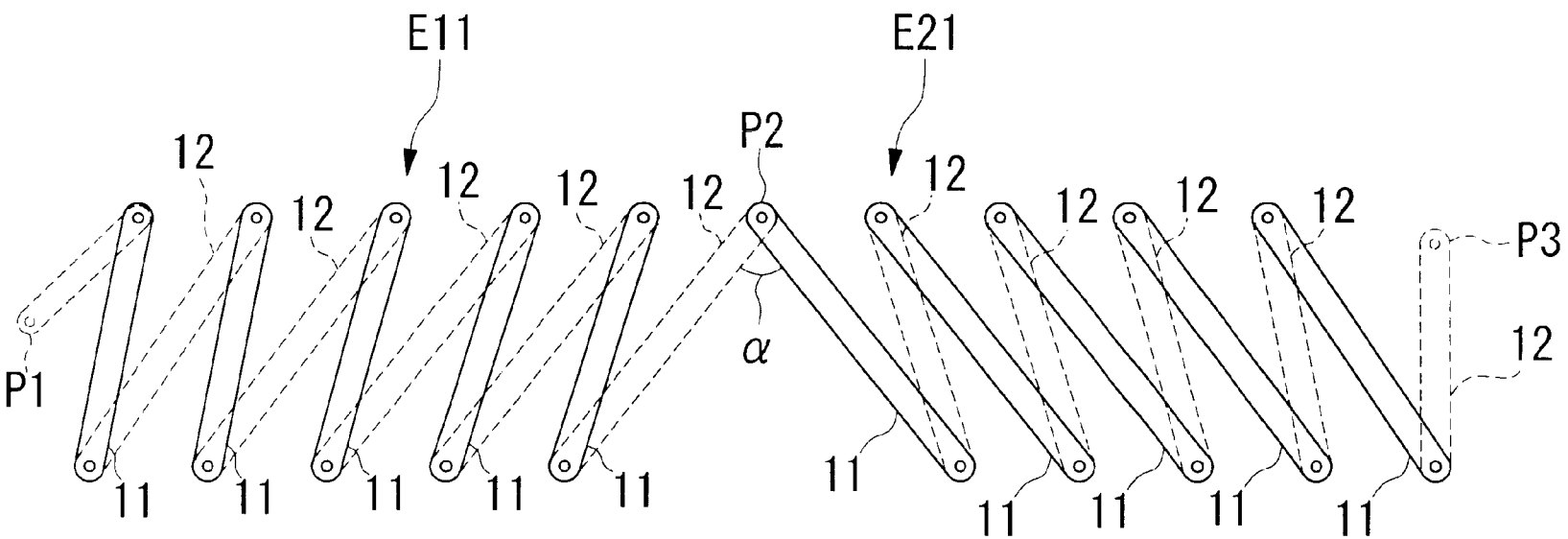
FIG. 4 is a top view of FIG. 3, and is an enlarged view of the inductance section of the antenna.
Figure 5:
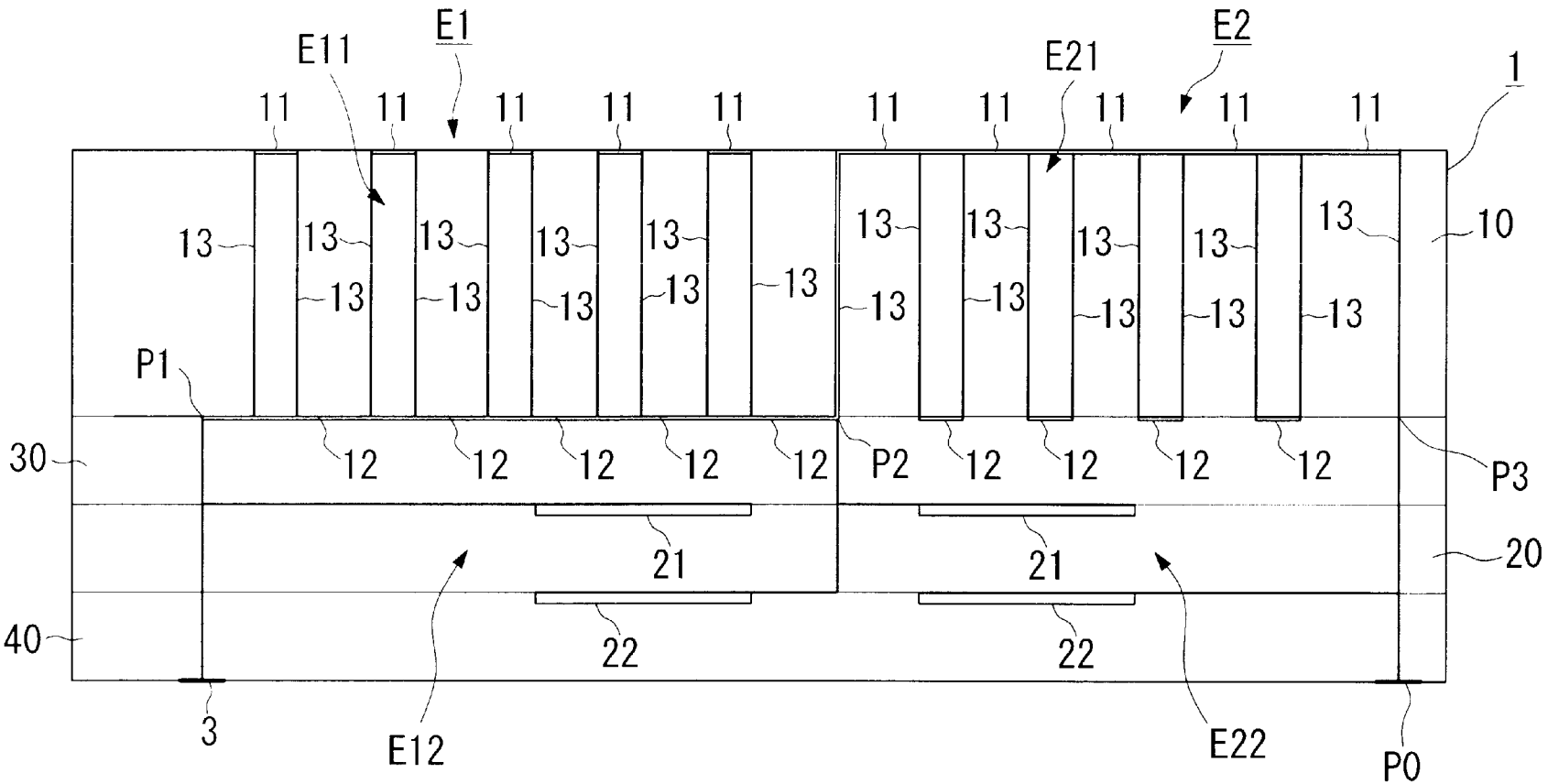
FIG. 5 is a schematic diagram of a lamination structure of the antenna main body.

Further, as shown in FIG. 4, the conductor patterns 11, 12 of the resonance section E1, and the conductor patterns 11, 12 of the resonance section E2 are formed at different angles to the coil axes. More specifically, the conductor patterns 12 of the inductance section E11 and the conductor patterns 11 of the inductance section E21 intersect at about 90 degrees or a slightly more acute angle $\alpha$ at the junction point P2, as shown in a top view in FIG. 4.

The condenser sections E12, E22 are comprised by respective conductor patterns 21 (conductor sections) having a roughly square shape formed on one surface of the substrate plate 20 (plate shaped substrate), and respective conductor patterns 22 (conductor sections) having a roughly square shape formed on other surface of the substrate plate, that are oriented so that conductor patterns 21 and conductor patterns 22 are placed in opposition. Then, one conductor pattern 21 of the resonance section E1 is connected electrically to the feed point 3 while other conductor pattern 22 of the resonance section E1 is connected electrically to the junction point P2. And, one conductor pattern 21 of the resonance section E2 is connected electrically to the junction point P2 while other conductor pattern 22 of the resonance section E2 is connected electrically to the junction point P3. The capacitance value of the capacitance sections E12, E22 in this embodiment is 30 pF at 1 MHz.

Here, the substrate plates 10, 20 are laminated as a unit with an intervening substrate plate 30 (plate shaped substrate), comprised primarily of alumina, and another substrate plate 40 (plate shaped substrate) is laminated on the substrate plate 20 comprised primarily of alumina, and all the substrates are made into one unit to form the antenna main body 1.

The grounding line section 2 is comprised of a line conductor pattern of about 1 mm line width formed on the printed board X (substrate plate) including an insulator, and extends from the reference point O (start terminal), which is connected to the coaxial cable C, and forms a loop shape having an opening around the antenna main body 1. In this embodiment of the antenna A, which operates at about 450 MHz, the grounding line section 2 and the antenna main body 1 are separated by at least 10 mm so as not to lower the antenna gain by the effect of the antenna main body 1 and the grounding line section 2 shorting through a capacitance. The grounding line section 2 includes a terminal section Q1 (a first end terminal) and another terminal section Q2 (a second end terminal) which are formed at the opening of the loop shape and locating near to the junction point P0, and is essentially comprised by a first grounding section 2*a* (a conductor portion) that extends from the reference point O to reach the first end terminal Q1, and a second grounding section 2*b* (a conductor portion) that extends from the reference point O to reach the second end terminal Q2.

The first grounding section 2*a* extends, in the top view, towards a first direction (bottom direction in FIG. 2) along the direction of the length of the antenna main body 1 starting from the reference point O, and bends 90 degrees to extend in the anti-clockwise direction, as shown in FIG. 2, and again bends 90 degrees to extend in the anti-clockwise direction towards a second direction (top direction in FIG. 2) along the direction of the length of the antenna main body 1, and again bends 90 degrees in the anti-clockwise direction, and extends towards the junction point P0 of the antenna main body 1. Here, the length from the reference point O to the first end terminal Q1 is chosen to equal one quarter of the wavelength of a radio wave at the center frequency.

The second grounding section 2*b* extends towards the second direction (top direction in FIG. 2) along the direction of the length of the antenna main body 1 starting from the reference point O and the length from the reference point O to the second end terminal Q2 is chosen to equal one eighth of the wavelength of the radio wave at the center frequency.

The impedance matching section 4 is comprised by: a matching capacitance section 41 inserted electrically in series between the junction point S connected to the inner conductor of the coaxial cable C and the feed point 3 of the antenna main body 1; and a matching inductance section 42 connected electrically to the feed point 3 and the first grounding section 2*a* of the grounding line section 2, as a whole, so as to match with an impedance value of 50 Ω of the wave transmission/reception circuit system. FIG. 6 shows an equivalent circuit for these connections.

In this example, the matching capacitance section 41 having a capacitance of 3 pF at 450 MHz is mounted on the printed board X, and the matching inductance section 42 is comprised by a linear conductor pattern formed on the printed board X so as to provide about 5 nH at 450 MHz, and one end is connected to the feed point 3 and other end is connected to a connection site M which is the midpoint between the reference point O of the first grounding section 2*a* and the first end terminal Q1. And, the length of a part of the first grounding section 2*a* between the reference point O and the connection site M is one eighth of the wavelength of the radio wave at the center frequency.

The frequency adjusting capacitance section 5 is comprised by inserting and mounting the capacitors 51 electrically between the junction point P0 and the second end terminal Q2 of the second grounding section 2*b* on the printed board X so as to provide capacitance values of 2.5 pF at 450 MHz, 4.7 pF at 300 MHz. Fine adjustments are made possible by having two capacitors 51.

On the printed board X, in addition to the conductor patterns described above, there are formed a "C"-shaped coaxial cable connection pattern X1, as shown in the top view in FIG. 2, for connecting the outer conductor of the coaxial cable C, and an antenna attaching pattern X2 for mounting the antenna main body 1 stably on the printed board X, and furthermore, at the location of the feed point 3, it has a feed pattern X3 of a somewhat wide width. Also, on its outer periphery, for example, a cutaway section X4 is provided so as to fit within the inner attachment space of the device having the transmission and reception capabilities.

In this embodiment of the antenna A, the antenna main body 1 is comprised by circuits formed on a plurality of substrate plates 10, 20, 30 and 40 which are laminated each other to obtain a compact size, and further, because the antenna main body 1 is mounted on the printed board X with the grounding line section 2, it is made to facilitate assembling of the antenna as one unit into various devices having wave transmission and reception capabilities.

In operation, antenna A emits radio waves at a center frequency of the resonance frequency produced by the cooperative action of the antenna main body 1 and the frequency adjusting capacitance section 5. In this case, the grounding line section 2 is fabricated so as to surround the antenna main body 1, and also, radio waves are emitted as a results of cooperative action of the antenna main body 1 and the grounding line section 2 which is floated from the surrounding ground, so that the antenna A is not susceptible to the neighboring mounting environment such as grounded metal parts, resulting that the antenna gain is not lowered. The grounding line section 2 is discontinuous between the first and second end terminals Q1, Q2 due to line severing so as not to form a closed ring, and therefore, the electromagnetic energy from antenna A can be released to the surrounding without causing eddy current inside the grounding line section 2. Here, because the grounding line section 2 is distanced from the antenna main body 1 by about 10 mm, shorting between the antenna main body 1 and the grounding line section 2 is prevented to preserve the gain. Moreover, because the length of the first grounding section 2*a* of the grounding line section 2 is one quarter of the wavelength at the center frequency, the first grounding section 2*a* is made to resonate in fixed phase in such a way that the node of the waves always coincides with the reference point O of the shorted first grounding section 2*a*.

Also, because the connection site M connected to the one end of the matching inductance section 42 of the impedance matching section 4 is provided in the midpoint of the first grounding section 2*a,* and the length between the reference point O and the connection site M is set at one eighth of the wavelength of the radio wave at the center frequency, impedance matching of circuits in the wave transmission/reception system and antenna A can be carried out in a manner that does not lower the antenna gain.

Also, because the length between the second grounding section 2*b* of the grounding line section 2 is one eighth of the wavelength of the radio wave at the center frequency, and the frequency adjusting capacitance section 5 is provided between the junction point P0 of the antenna main body 1 and the second end terminal Q2, the center frequency used in transmitting and receiving radio waves can be adjusted in a manner that does not lower the antenna gain.

According to the above mentioned embodiment, the antenna A can be easily assembled into various devices having radio wave communication capabilities. Here, the antenna A can be incorporated into the devices without adverse effects of environment in which the antenna is mounted. Moreover, it is possible to carry out impedance matching between the antenna A and the wave transmission/reception system without reducing the antenna gain. Adjustment of the center frequency at which radio waves are received and transmitted can be also carried out so as not to lower the antenna gain.

It should be noted that although the center frequency for transmitting and receiving radio waves was fixed at 450 MHz, the center frequency need not be restricted to this value. As the center frequency increases further, the antenna main body as well as the grounding line section can be made smaller.

Also, for the length between the reference point O and the first end terminal Q1, it is permissible to use an integral multiple of one quarter of the wavelength of the radio wave at the center frequency used to transmit/receive radio waves from antenna A. In this embodiment, the length of the first grounding section 2*a* of the grounding line section 2 was made equal to one quarter of the wavelength of the radio wave in order to make a smaller antenna A, but this length does not need to be limited to this length such that one half or three quarter of the wavelength of the radio wave may be chosen.

Table 1 shows the results of absolute gain produced by an antenna having an antenna main body, whose external dimensions are 26 mm length, 5 mm width and 2 mm thickness, operated at 450 and 300 MHz by adjusting the length of the first grounding section 2*a* and the second grounding section 2*b* as shown in the table.

TABLE 1

| Frequency (MHz) | | | | 450 | | | | 300 |
|---|---|---|---|---|---|---|---|---|
| Wavelength (cm) | | | | 66 | | | | 100 |
| #1 gnd 2a (cm) | None | 8 | 10 | 16 | 16 | 20 | 33 | 25 |
| #2 gnd 2b (cm) | None | None | 8 | None | 8 | 8 | 8 | 12 |
| Gain ($dB_i$) | −6.86 | −1.61 | −2.55 | 0.94 | 2.07 | −0.98 | 2.20 | 2.55 |

From Table 1, it can be seen that, when operating at 450 MHz and the length of the first grounding section 2*a* is one quarter of the wavelength at 66 cm or the length is one half of the wavelength at 66 cm, the gains are, in fact, increased. Also, when the length of the second grounding section 2*b* is made equal to one eighth of the wavelength 66 cm, the gain is increased even though the length of the first grounding section 2*a* is fixed at one quarter of the wavelength.

It can also be seen that, while maintaining the parameters for the second grounding section 2*b,* when the length of the first grounding section 2*a* is increased by an integral multiple of one quarter of the wavelength, the gain is increased.

It should be noted that, although the absolute value of the gain is not increased very much, the gain does show a peak when the length of the first grounding section 2*a* is one eighth of the wavelength, and the gain is increased compared with the values of the gain obtained when the length of the first grounding section 2*a* is shorter or longer than the value at the peak. Further, the peak value is clearly higher compared with an antenna having no grounding line section.

In the case of operation at 300 MHz, it was found that the gain is increased when the length of the first grounding section 2*a* is one quarter of the wavelength at 100 cm, and the length of the second grounding section 2*b* is one eighth of the wavelength.

Also, in this embodiment, the structure is such that the frequency adjusting capacitance section 5 is inserted between the junction point P0 and the second end terminal Q2 of the second grounding section 2*b*, and is connected to the exterior of the antenna A, however, it is permissible to arrange a structure such that the frequency adjusting capacitance section 5 is provided inside the antenna A, and the second end terminal Q2 of the second grounding section 2*b* is connected directly to the junction point P0.

Furthermore, it is permissible to construct a structure such that the second end terminal Q2 is connected directly to the junction point P0, and form a first electrode of the frequency adjusting capacitance section 5 at the second terminal Q2, while, on antenna A, a second electrode is provided to form the frequency adjusting capacitance section 5 in cooperation with the first electrode so that when antenna A is mounted on the printed board X, the first and second electrodes form the frequency adjusting capacitance section 5. In this case, by adjusting the distance and position of antenna A relative to the printed board X, capacitance values of the frequency adjusting capacitance section 5 can be adjusted, in other words, the center frequency used for transmission/reception of radio waves can be adjusted flexibly.

Figure 7:
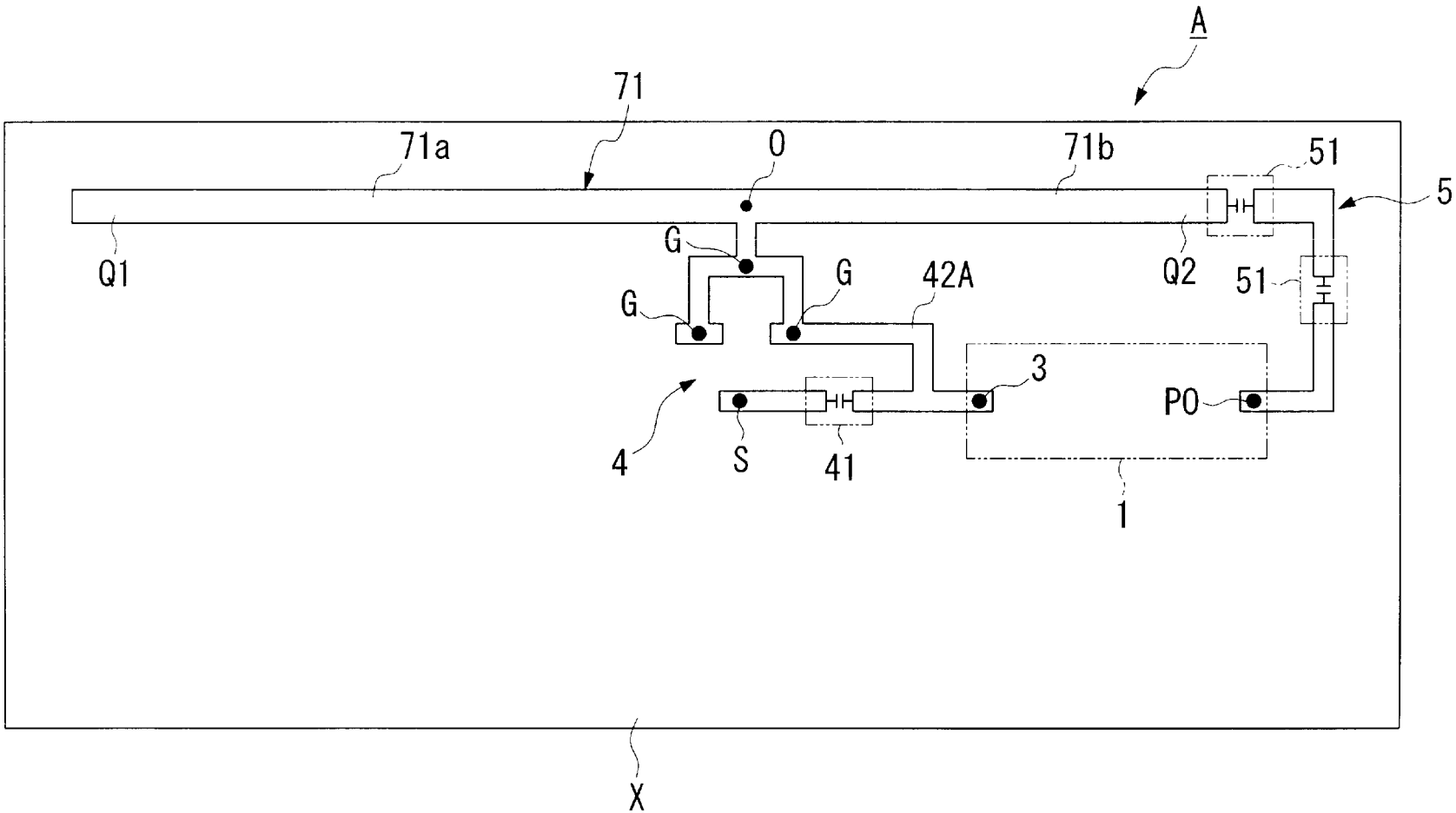
FIG. 7 is a diagram to show a grounding line section formed on the substrate of another embodiment of the antenna of the present invention.

Also, in the embodiment described above, the structure is arranged in such a way that the first and second grounding sections 2*a*, 2*b* surround the antenna main body 1, but, as shown in FIG. 7, it is permissible to arrange a structure so that the first and second grounding sections 71*a,* 71*b* are used to form a grounding section 71 essentially in a linear pattern. That is, in FIG. 7, the first grounding section 71*a* corresponds to the first grounding section 2*a* described above and has a length equal to one quarter of the wavelength of the radio wave at the center frequency, and is formed so as to act as an extension of the second grounding section 71*b*. And, the impedance matching section 42A for impedance matching is formed by a pattern that extends from the feed point 3 of the antenna main body 1 and connects to the junction point G.

The impedance matching section 4 is comprised by: a matching capacitance section 41 inserted electrically in series between the junction point S connected to the inner conductor of the coaxial cable C and the feed point 3 of the antenna main body 1; and a matching inductance section 42A connected electrically to the feed point 3 and the first grounding section 71*a* of the grounding line section 2, as a whole, so as to match with an impedance value of 50 Ω of the wave transmission/reception circuit system.

Here, the matching capacitance section 41 having a capacitance of 3 pF at 450 MHz is mounted on the printed board X, and the matching inductance section 42A is comprised by a "L"-shaped conductor pattern formed on the printed board X so as to provide about 5 nH at 450 MHz, and one end is connected electrically to the feed point 3 and other end is connected electrically to the junction point G.

Also, the frequency adjusting capacitance section 5 provides capacitance values of 2.5 pF at 450 MHz and 4.7 pF at 300 MHz, and is comprised by inserting and mounting the capacitors 51 electrically between the junction point P0 and the second end terminal Q2 of the second grounding section 71*b* on the printed board X. Fine adjustments are made possible by having two capacitors 51.

In FIG. 7, all other parts that are the same as those shown in FIGS. 1 to 6 are given the same reference numerals, and their explanations are not necessary.

According to this variation example, because the ground plate (grounding line section) is made in a straight line as a grounding wire, it can be made to function effectively as the radiating element, enabling the antenna characteristics (gain and directivity) to be further improved. Table 2 shows the results of absolute gain produced by an antenna A, shown in FIG. 7, having an antenna main body whose external dimensions are 26 mm length, 5 mm width and 2 mm thickness, operated at 450 and 300 MHz by adjusting the length of the first grounding section 71*a* and the second grounding section 71*b* as indicated in the table.

TABLE 2

| Frequency (MHz) | | | | 450 | | | | 300 |
|---|---|---|---|---|---|---|---|---|
| Wavelength (cm) | | | | 66 | | | | 100 |
| #1 gnd 71a (cm) | None | 8 | 10 | 16 | 16 | 20 | 33 | 25 |
| #2 gnd 71b (cm) | None | None | 8 | None | 8 | 8 | 8 | 12 |
| Gain ($dB_i$) | −6.86 | −1.52 | −2.45 | 1.11 | 2.32 | −0.55 | 2.47 | 2.79 |

From Table 2, it can be seen that, when operating at 450 MHz and the length of the first grounding section 71*a* is one quarter of the wavelength at 66 cm or the length is one half of the wavelength at 66 cm, the gains are, in fact, increased. Also, when the length of the second grounding section 71*b* is made equal to one eighth of the wavelength at 66 cm, the gain is increased even though the length of the first grounding section 71*a* is fixed at one quarter of the wavelength.

It can also be seen that, while maintaining the parameters for the second grounding section 71*b*, when the length of the first grounding section 71*a* is increased by an integral multiple of one quarter of the wavelength, the gain is increased.

It should be noted that, although the absolute value of the gain is not increased very much, the gain does show a peak when the length of the first grounding section 71*a* is one eighth of the wavelength, and the gain is increased compared with the values of the gain obtained when the length of the first grounding section 71*a* is shorter or longer than the value at the peak. Further, the peak value is clearly higher compared with an antenna having no grounding line section.

In the case of operation at 300 MHz, it was found that the gain is increased when the length of the first grounding section 71*a* is one quarter of the wavelength at 100 cm, and the length of the second grounding section 71*b* is one eighth of the wavelength.

Also, it can be seen that, compared with the case of having the grounding line section surrounding the antenna main body, the gain of the present antenna is increased. However, when the grounding line section is arranged to surround the antenna main body, the overall size of the antenna can be made smaller, but, as can be seen by comparing the results shown in Tables 1 and 2, the values of antenna gain shown in Table 1 are not greatly lower than those shown in Table 2. Accordingly, the present invention enables the user to choose either to aim for high gain by selecting the shapes of the grounding line section as shown in FIG. 7, or to aim for a compact size of the overall antenna as shown in FIGS. 1 and 2.

It should be noted that the shapes of the grounding line section are not limited to those shown in FIGS. 1 and 2 or FIG. 7, and it is obvious that other shapes can be chosen to suit the casing of a device that contains the present antenna.

Further, in the antennas described above, the antenna main body has those structures shown in FIGS. 3 to 6, but a helical antenna may be used for the antenna main body.

What is claimed is:

1. An antenna comprising:

an antenna main body that resonates at a center frequency and emits radio waves at the center frequency;

a grounding line section connected to a ground-side of a feed line supplying power to the antenna main body, said grounding line section having a conductor portion that extends from a start terminal at which the grounding line section is connected to the feed line to a first end terminal; and an impedance matching section provided between a feed end of the antenna main body and the feed line for matching impedance values, the impedance matching section having a matching inductance section such that ends of the matching inductance section are connected electrically to the feed end of the antenna main body and to a midpoint between the start terminal of the grounding line section and the first end terminal, respectively, wherein a length of the conductor portion extending from the start terminal of the grounding line section to the first end terminal of the grounding line section is one quarter or an integral multiple of one quarter of the wavelength of a radio wave at the center frequency.

2. An antenna according to claim 1, wherein the grounding line section further has a conductor portion formed by extending from the start terminal to a second end terminal that is distanced from the first end terminal.

3. An antenna comprising:

an antenna main body that resonates at a center frequency and emits radio waves at the center frequency;

a grounding line section connected to a ground-side of a feed line supplying power to the antenna main body, said grounding line section having a conductor portion that extends from a start terminal at which the grounding line section is connected to the feed line to a first end terminal; and an impedance matching section provided between a feed end of the antenna main body and the feed line for matching an input impedance value the impedance matching section having a matching inductance section such that ends of the matching inductance section are connected electrically to the feed end of the antenna main body and to a connection site located between the start terminal and the first end terminal of the grounding line section, respectively in such a way that a length of a part of the grounding line section extending from the start terminal to the connection site is made equal to one eighth of the wavelength of a radio wave at the center frequency, wherein a length of the conductor portion extending from the start terminal of the grounding line section to the first end terminal of the grounding line section is one quarter or an integral multiple of one quarter of the wavelength of a radio wave at the center frequency.

4. An antenna comprising:

an antenna main body that resonates at a center frequency and emits radio waves at the center frequency;

a grounding line section connected to a ground-side of a feed line supplying power to the antenna main body, said grounding line section having a conductor portion that extends from a start terminal at which the grounding line section is connected to the feed line to a first end terminal; and a frequency adjusting capacitance section provided between an exit end of the antenna main body opposite to the feed point of the antenna main body and the second end terminal of the grounding line section for adjusting the center frequency, wherein a length of the conductor portion extending from the start terminal of the grounding line section to the first end terminal of the grounding line section is one quarter or an integral multiple of one quarter of the wavelength of a radio wave at the center frequency, and wherein the grounding line section further has a conductor portion formed by extending from the start terminal to a second end terminal that is distanced from the first end terminal.

5. An antenna according to claim 4, wherein a length of the conductor portion extending from the start terminal of the grounding line section to the second end terminal of the grounding line section is one eighth of the wavelength of a radio wave at the center frequency.

6. An antenna according to claim 5, wherein the grounding line section is provided so that the conductor portion formed by extending from the start terminal to the first end terminal and the conductor portion formed by extending from the start terminal to the second end terminal surround the antenna main body, so that the first end terminal and the second end terminal are opposite to each other in such a way that these conductor portions form a loop shape having an opening at the first end terminal and at the second end terminal.

7. An antenna according to claim 5, wherein the grounding line section includes a conductor pattern fabricated on a substrate.

8. An antenna according to claim 7, wherein the antenna main body includes a plurality of resonance sections, each having an inductance section and a capacitance section connected electrically in parallel, said plurality of resonance sections being connected electrically in series so as to resonate at the center frequency.

9. An antenna according to claim 8, wherein the inductance section and the capacitance section include a plurality of conductor sections formed on a plurality of laminated substrate plates, and the plurality of substrate plates are formed as one unit.

10. An antenna according to claim 9, wherein the antenna main body is mounted on the substrate body for integrating the antenna main body with the substrate body.

* * * * *